United States Patent [19]

McCabe

[11] 3,964,629

[45] June 22, 1976

[54] COMBINED DECANTER AND TRAY

[75] Inventor: John H. McCabe, Worcester, Mass.

[73] Assignee: Fox Specialty Co., Inc., Worcester, Mass.

[22] Filed: June 23, 1975

[21] Appl. No.: 589,071

[52] U.S. Cl. ..... 220/23.86; D7/20; D7/21; 215/100 R

[51] Int. Cl.² ..... B65D 1/02; A47G 19/32; A47G 23/08

[58] Field of Search ..... 220/23.83, 23.86, 85 H; D7/20, 21, 27, 71, 130; 215/100 R, 100 A

[56] References Cited

UNITED STATES PATENTS

| | | | |
|---|---|---|---|
| 2,056,943 | 10/1936 | Lehman | 220/23.83 |
| 2,997,199 | 8/1961 | Reachi | 220/23.86 |
| 3,162,344 | 12/1964 | Sabol | D7/20 |
| 3,738,525 | 6/1973 | Knapp | 220/23.83 |
| D129,530 | 9/1941 | Manaster | D7/71 |
| D176,971 | 2/1956 | Beinert | D7/71 |

FOREIGN PATENTS OR APPLICATIONS

| | | | |
|---|---|---|---|
| 312,784 | 11/1933 | Italy | 270/23.86 |
| 375,486 | 6/1932 | United Kingdom | 220/23.86 |

*Primary Examiner*—George E. Lowrance

[57] ABSTRACT

A combined decanter and tray for dispensing and serving beverages in which the tray, the decanter and cup-like receptacles containing beverages to be served may be lifted and transported from place to place by means of the handle of the decanter but in which the decanter may be removed from the tray by rotating it to a predetermined position relative to the surface of the tray. The tray comprises a substantially arcuate central orifice for receiving the lower portion of the decanter and it may also include a plurality of smaller orifices for receiving cup-like receptacles for beverages to be served. The central orifice has slot means extending outwardly from its periphery and the lower portion of the decanter has outwardly extending key means for registering with and sliding through said slot means so that after insertion of the key means through the slot means upon rotation of the decanter relative to the central orifice the key means is moved out of registry with the slot means thereby permitting the tray, the decanter and the cup-like receptacles to be lifted and transported as a unit by grasping the handle of the decanter.

7 Claims, 11 Drawing Figures

COMBINED DECANTER AND TRAY

BACKGROUND OF THE INVENTION

This invention provides a combined decanter, tray and cup-like receptacles which can be transported as a unit from a kitchen, bar or the like to the room where the beverage is to be served to guests. The decanter is merely grasped by the handle and that permits carrying the combined decanter, tray and receptacles as a unit. Beverages such as iced tea, fruit juice, milk, water, cocktails, or the like, may be poured into the receptacles before or after the tray is transported to the room where the guests are located. The full decanter may be removed from the tray by rotating it about its vertical axis to a predetermined position to refill the receptacles as desired.

As far as I know this combined decanter and tray is novel and has not been used nor disclosed in any prior patent or publication prior to my invention.

One object of this invention is to provide a new combined decanter and tray.

Another object is to provide such a combined decanter and tray which is economical to manufacture.

A further object is to provide such a combined decanter and tray which is easy to use by the average host or hostess.

Yet another object is to provide such a combined decanter and tray which is durable and may be used for years without need for repairs or replacement.

Another object is to provide a novel combined decanter, tray and receptacles for serving beverages.

Other objects and advantages of the invention will be apparent to persons skilled in the art from the following description and the accompanying drawings.

SUMMARY OF THE INVENTION

In general the tray comprises a generally flat upper surface and an arcuate substantially centrally disposed orifice having slot means extending outwardly from its arcuate side wall towards the outer side of the tray. The decanter has an outer side wall which is substantially arcuate in horizontal cross section, the lower portion of the side wall is of smaller diameter than the upper portion and there is an outwardly extending substantially horizontal flange means connecting the upper end of the side wall of the lower portion of the decanter and the lower end of the side wall of the upper portion of the decanter.

The decanter also includes key means projecting outwardly from the periphery of the lower portion of its side wall below the substantially horizontal flange means and this key means is slideable through the slot means when the lower portion of the decanter is inserted through the substantially centrally disposed orifice of the tray. The decanter also includes a handle.

Upon inserting the lower portion of the decanter in the arcuate central orifice of the tray with the key means in registry with the slot means the key means slides downwardly through the slot means until the upper end of the key means is below the central portion of the tray. Then by rotating the decanter about its vertical axis by means of its handle the upper portion of the key means becomes located below and outwardly of the lower end of the side wall of the central orifice and the tray and decanter may be lifted with the handle of the decanter by the user, thereby permitting transportation of the combined decanter and tray to the desired location. Upon rotation of the decanter about its vertical axis to a position wherein the key means again registers with the slot means the decanter may be removed from the tray and used to initially fill the cup-like receptacles or to refill them when the initial contents has been consumed by the guests.

In a preferred embodiment the upper surface of the tray comprises a pair of upwardly extending guide means for engaging the sides of the lower portion of the handle of the decanter when the key means is out of registry with the slot means, thereby forming a visual indication to the user that the decanter is in a position wherein it cannot be removed from the central orifice of the tray when the sides of the lower portion of the handle are located between the guide means. Thus the user knows that the decanter and tray may be transported by grasping the handle of the decanter without the decanter being lifted from the tray.

In another preferred embodiment substantially horizontal flange means provided on the decanter engages the upper surface of the tray near the periphery of the central orifice and prevents the upper portion of the decanter from passing downwardly through the central orifice.

Preferably the slot means comprises a pair of oppositely disposed slots and the key means comprises a pair of oppositely disposed projections.

In yet another preferred embodiment the tray includes a plurality of spaced smaller arcuate orifices located between the central orifice and the periphery of the tray and each of these smaller orifices is adapted to receive a cup-like receptacle for serving the liquids to guests.

In a still further preferred embodiment the tray comprises a plurality of downwardly extending leg means for supporting the upper surface of the tray at a predetermined distance above a table top or the like.

In another preferred embodiment each leg means is located adjacent to the outer periphery of one of the smaller arcuate orifices and each leg means comprises an inwardly extending member at its lower end for supporting the bottom of a cup-like receptacle when positioned in the smaller arcuate orifice.

The decanter may be molded of polypropylene, the tray of polystyrene and the cup-like receptacles of polypropylene. Thus the decanter and the cup-like receptacles are dishwasher safe and each of the elements is economical to manufacture.

However the invention is not limited to use of the aforesaid materials for the manufacture of the elements.

From the foregoing it will be obvious to persons skilled in the art that my combination decanter and tray is novel, economical to manufacture, durable in use and that it is easy to use by an ordinary host or hostess.

DESCRIPTION OF THE EMBODIMENT SHOWN IN THE DRAWINGS

Figure 1:
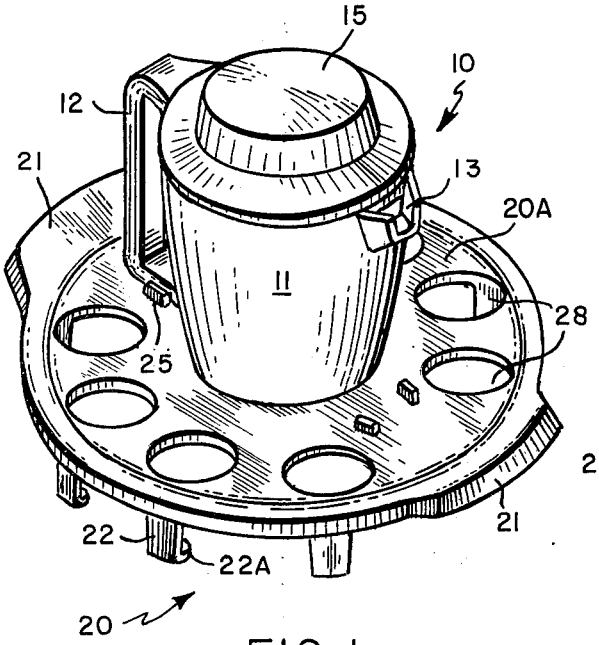
FIG. 1 is an isometric view of a combined decanter and tray embodying the invention.
Figure 2:
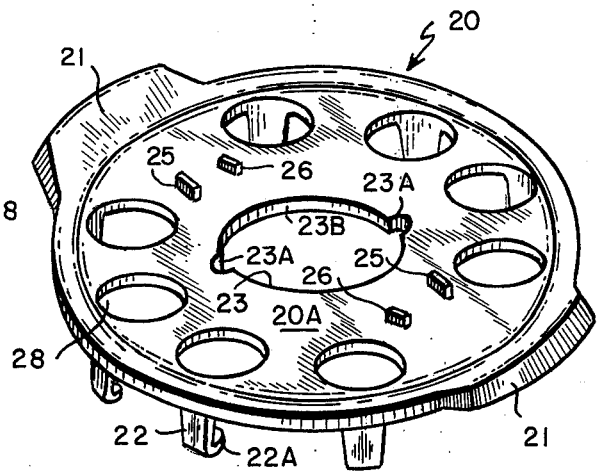
FIG. 2 is an isometric view of the tray with the decanter removed.
Figure 3:
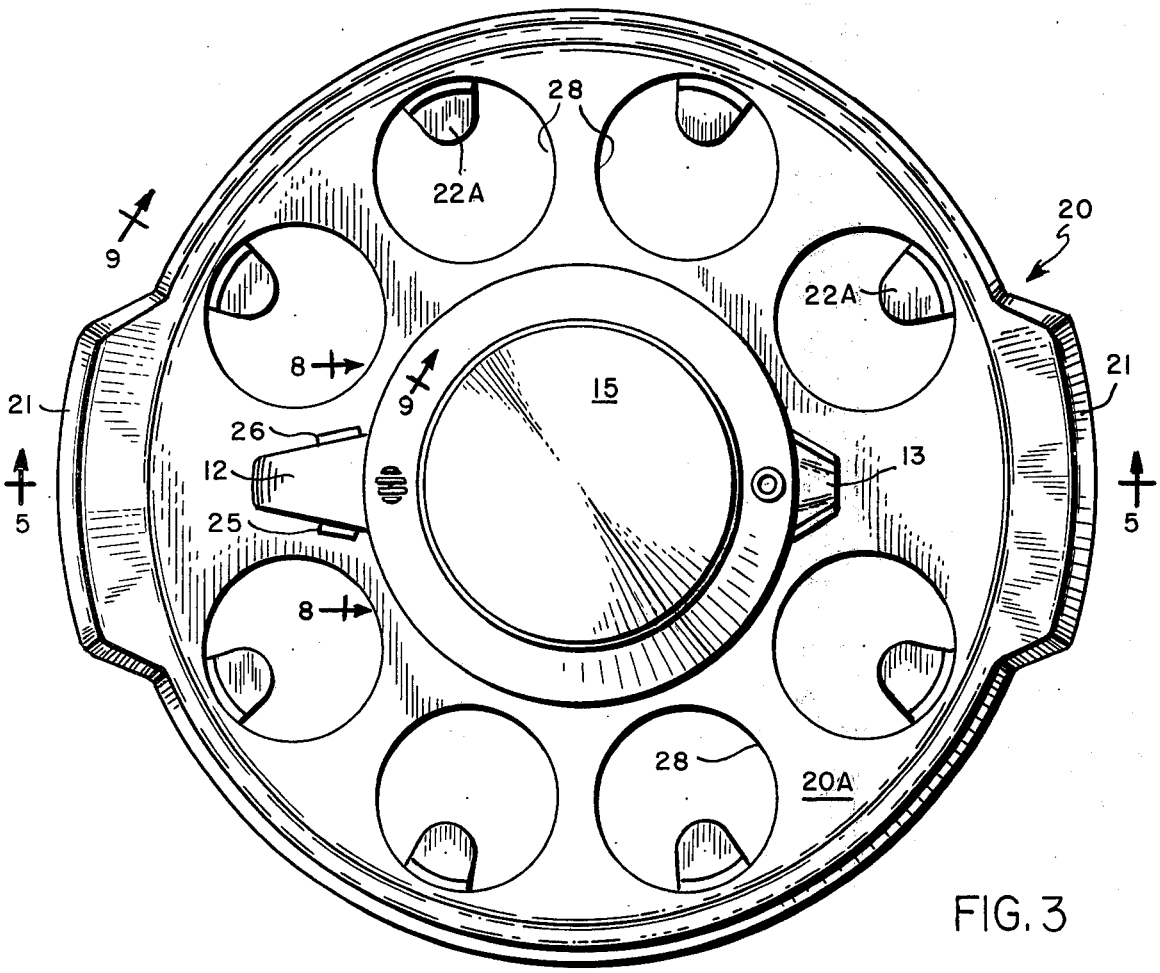
FIG. 3 is an enlarged top plan view of the combined decanter and tray.
Figure 4:
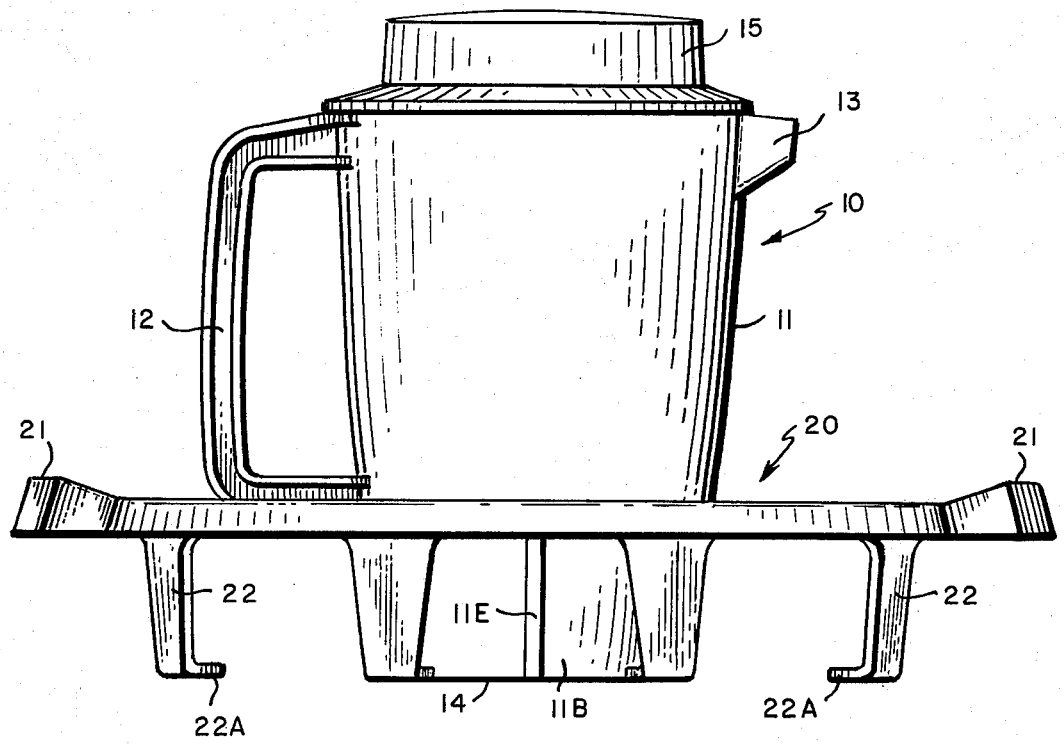
FIG. 4 is an enlarged side elevation of the combined decanter and tray of FIG. 3.

Referring to the drawings, the decanter of the present invention is generally indicated by the numeral 10 and the tray by the numeral 20.

The decanter comprises a generally arcuate side wall 11, handle 12, snout 13 and bottom wall 14. A substantially horizontal flange means 11A (FIG. 5) extends around the periphery of the side wall between the upper end of the lower portion 11B and the lower end of the upper portion 11C of the side wall of the decanter.

Figure 5:
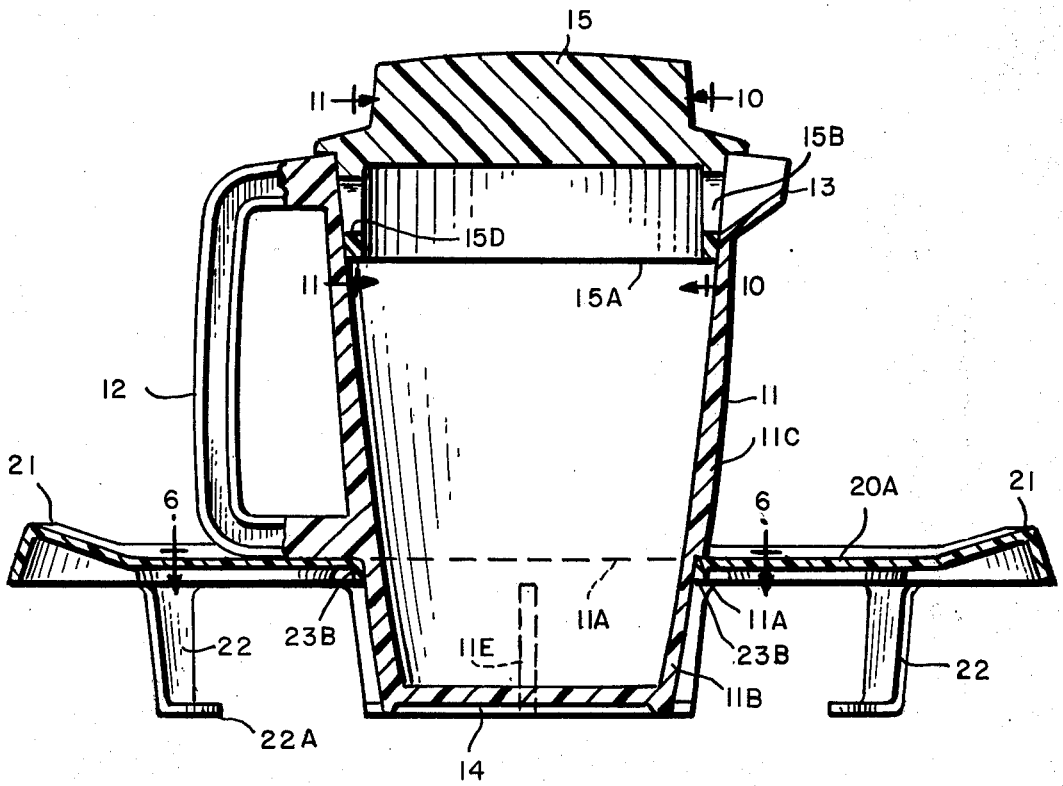
FIG. 5 is a section on the line 5—5 of FIG. 3 with part of the handle of the decanter shown in elevation.
Figure 10:
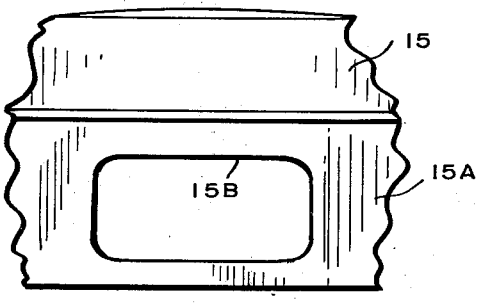
FIG. 10 is an enlarged section on the line 10-10 of FIG. 5 showing an orifice in the flange of the cover of the decanter in pouring registry with the snout of the decanter.
Figure 11:
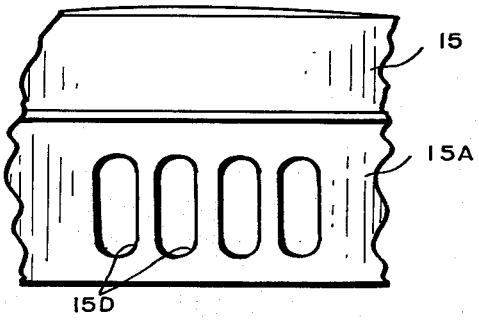
FIG. 11 is a section on the line 11-11 of FIG. 5 showing a series of longitudinal orifices in the flange of the cover which function to prevent ice cubes or other solids from passing outwardly through the snout when the orifices are in registry with the snout of the decanter.

The decanter also comprises a cover 15 which includes a downwardly extending flange portion 15A which is snugly received in the opening in the top of the decanter (FIGS. 5, 10 and 11). One side of the flange 15A is provided with a substantially rectangular orifice 15B (FIGS. 5 and 10) adapted to register with the inner opening of the snout 13 when the cover is in one position. The flange 15A is also provided with a series of vertical orifices 15D (FIGS. 5 and 11) which are adapted to register with the inner opening of the snout when the cover is in a different position. These vertical orifices function to prevent ice cubes or other solids from passing outwardly through the snout.

The decanter is also provided with a pair of oppositely disposed key means 11E (FIGS. 4, 5, 6 and 7) the function of which will be described below.

The decanter may be made of polypropylene which is dishwashwer safe.

The tray 20 is provided with a substantially flat upper surface 20A and has a pair of oppositely disposed handles 21 (FIG. 5). It is also provided with a plurality of leg means 22 each of which has an inwardly extending member 22A at its lower end. An arcuate orifice 23 is provided at the center of the tray and a pair of oppositely disposed slot means 23A extend outwardly from this arcuate orifice. There is a downwardly extending flange 23B surrounding the arcuate orifice 23 and slot means 23A (FIG. 5).

Figure 8:
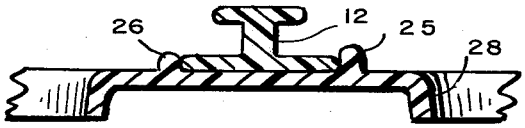
FIG. 8 is an enlarged section on the line 8—8 of FIG. 3 showing the handle of the decanter between a pair of upwardly extending guide means of the tray.

Two pairs of guide means 25,26 project upwardly from the surface of the tray. The guide means 25 are slightly higher than guide means 26 as shown in FIG. 8.

Figure 9:
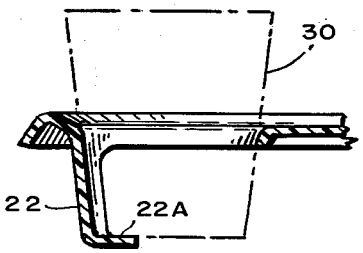
FIG. 9 is a section on the line 9-9 of FIG. 3 showing a cup-like receptacle in dot dash resting upon the inwardly extending member at the lower end of one of the legs.

A plurality of substantially arcuate smaller orifices 28 are provided between the central orifice 23 and the periphery of the tray. These orifices are adapted to receive cup-like receptacles 30 one of which is shown in dot dash in FIG. 9. It is to be noted that the bottom wall of the receptacle rests upon the inwardly projecting member 22A. With this construction cup-like receptacles of varying diameters may be used with the tray. These receptacles may be made of polypropylene which is dishwasher safe. The tray may be made of polystyrene.

Figure 7:
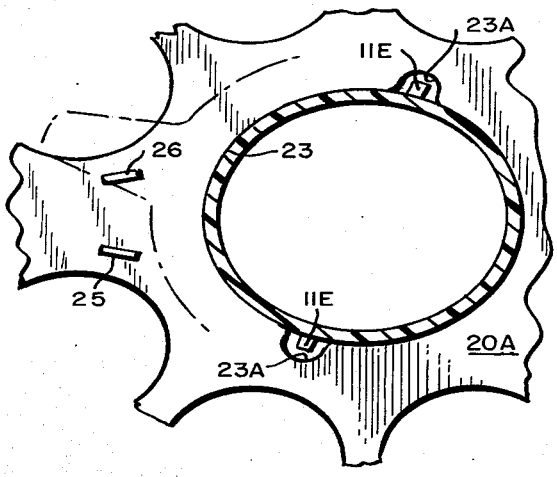
FIG. 7 is a section similar to FIG. 6 but showing the key means of the decanter in registry with the slot means of the tray.
Figure 6:
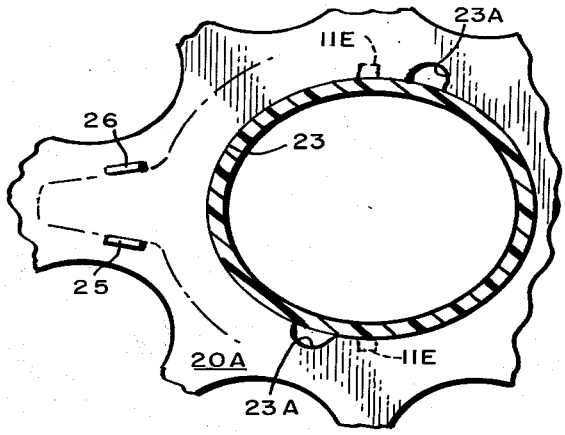
FIG. 6 is a section on the line 6—6 of FIG. 5 showing the decanter in dot dash lines rotated to a locked position.

To assemble the decanter with the tray the lower portion 11B is inserted in the central orifice 23 with the keys 11E registering with the slot means 23A as shown in FIG. 7. The downward movement of the decanter is stopped by engagement between the flange 11A with the upper surface of the tray—see FIG. 5. Then the decanter is rotated in a counterclockwise direction looking at FIG. 7 until the lower portion of the handle is positioned between the stop means 25,26 as shown in FIGS. 6 and 8. In this position the upper ends of the keys 11E are positioned a very short distance below the lower end of the flange 23B. In this position the entire tray and decanter together with receptacles located in the orifices 28 may be lifted and carried as a unit merely by grasping the handle of the decanter and lifting the entire combination.

To remove the decanter from the tray it is rotated a short distance in a clockwise direction looking at FIG. 6 until the keys 11E register with the slots 23A as shown in FIG. 7. Then the decanter may be lifted upwardly out of the orifice 23, the keys sliding upwardly through the slots 23A.

It will be apparent to persons skilled in the art that a combined decanter and tray embodying this invention satisfies the objects and provides the advantages stated above.

While one desirable embodiment of the invention has been shown in the drawings and described in the foregoing specification, it is to be understood that this disclosure is for the purpose of illustration only and that various changes in shape, proportion and arrangement of the elements as well as the substitution of equivalent elements for those herein shown and described may be made without departing from the spirit and scope of the invention as set forth in the appended claims.

I claim:

1. A combined decanter and tray, the tray comprising a generally flat upper surface and an arcuate substantially centrally disposed orifice having slot means extending outwardly from the arcuate side wall of said central orifice towards the outer side of the tray and the decanter having an outer wall which is substantially arcuate in horizontal cross section, the lower portion of said side wall being of smaller diameter than the upper portion, outwardly extending substantially horizontal flange means connecting the upper end of the side wall of said lower portion of the decanter and the lower end of the side wall of said upper portion of the decanter, key means projecting outwardly from the periphery of the lower portion of the side wall below said substantially horizontal flange means, said key means being sideable through said slot means when the lower portion of said decanter is inserted through said substantially centrally disposed orifice of the tray, and a handle for said decanter, whereby upon sliding said key means downwardly through said slot means and rotating said decanter by its handle the upper portion of the key means is located below a portion of the tray which is adjacent to the central orifice and the tray may be lifted by grasping the handle of the decanter permitting transportation of the combined decanter and tray, but upon rotation of said decanter to a position wherein said key means registers with said slot means the decanter may be removed from the tray.

2. A combined decanter and tray according to claim 1 wherein the upper surface of the tray comprises a pair of upwardly extending guide means for engaging the sides of the lower portion of said handle when said key means is out of registry with said slot means, thereby forming a visual indication that the decanter is in a position wherein it cannot be removed from the central orifice of the tray when the sides of the lower portion of the handle are located between said guide means.

3. A combined decanter and tray according to claim 1 wherein said substantially horizontal flange means engages the upper surface of the tray near the periphery of the central orifice and prevents the upper portion of the decanter from passing downwardly through the central orifice.

4. A combined decanter and tray according to claim 1 wherein said slot means comprises a pair of oppositely disposed slots and said key means comprises a pair of oppositely disposed projections.

5. A combined decanter and tray according to claim 1 wherein the tray comprises a plurality of spaced smaller arcuate orifices between said central orifice and the periphery of the tray, each smaller orifice being adapted to receive a cup-like receptacle for serving liquids such as water, milk, iced tea and the like.

6. A combined decanter and tray according to claim 1 wherein the tray comprises a plurality of downwardly extending leg means for supporting the upper surface of the tray at a predetermined distance above a table top or the like.

7. A combined decanter and tray according to claim 5 which also comprises a plurality of downwardly extending leg means for supporting the upper surface of the tray at a distance above the table top or the like, a leg means being provided adjacent to the outer periphery of each of said smaller arcuate orifices and each leg means comprising an inwardly extending member at its lower end for supporting the bottom of a cup-like receptacle positioned in the adjacent smaller arcuate orifice.

* * * * *